United States Patent [19]

Jackson

[11] 4,360,199

[45] Nov. 23, 1982

[54] PLACEMENT DEVICE FOR GOLF TEE AND BALL

[76] Inventor: Andrew Jackson, P.O. Box 137, Rochester, Wash. 98579

[21] Appl. No.: 218,614

[22] Filed: Dec. 22, 1980

[51] Int. Cl.[3] ..... A63B 57/00

[52] U.S. Cl. ..... 273/32.5

[58] Field of Search ..... 273/32 B, 33 A, 32 R, 273/32 D, 32 F, 33 R; 124/45; 294/19 A

[56] References Cited

U.S. PATENT DOCUMENTS 1,863,140 6/1932 Mulvaney ..... 273/33 A
1,864,516 6/1932 Becket ..... 273/33 A
3,206,197 9/1965 Miotke ..... 273/33 A
3,889,946 6/1975 Setecka ..... 273/33 A

*Primary Examiner*—Richard C. Pinkham
*Assistant Examiner*—T. Brown
*Attorney, Agent, or Firm*—Keith S. Bergman

[57] ABSTRACT

A manually manipulable tool to releasably hold a golf tee, with a golf ball in supported position thereon, for insertion in the earth. The tool provides a magazine for golf tees from which individual tees are fed to a holding arm where a golf ball is manually positioned thereon and the combination of ball and tee releasably maintained by a spring biased plunger for placement and subsequent release.

4 Claims, 7 Drawing Figures

FIG. 4
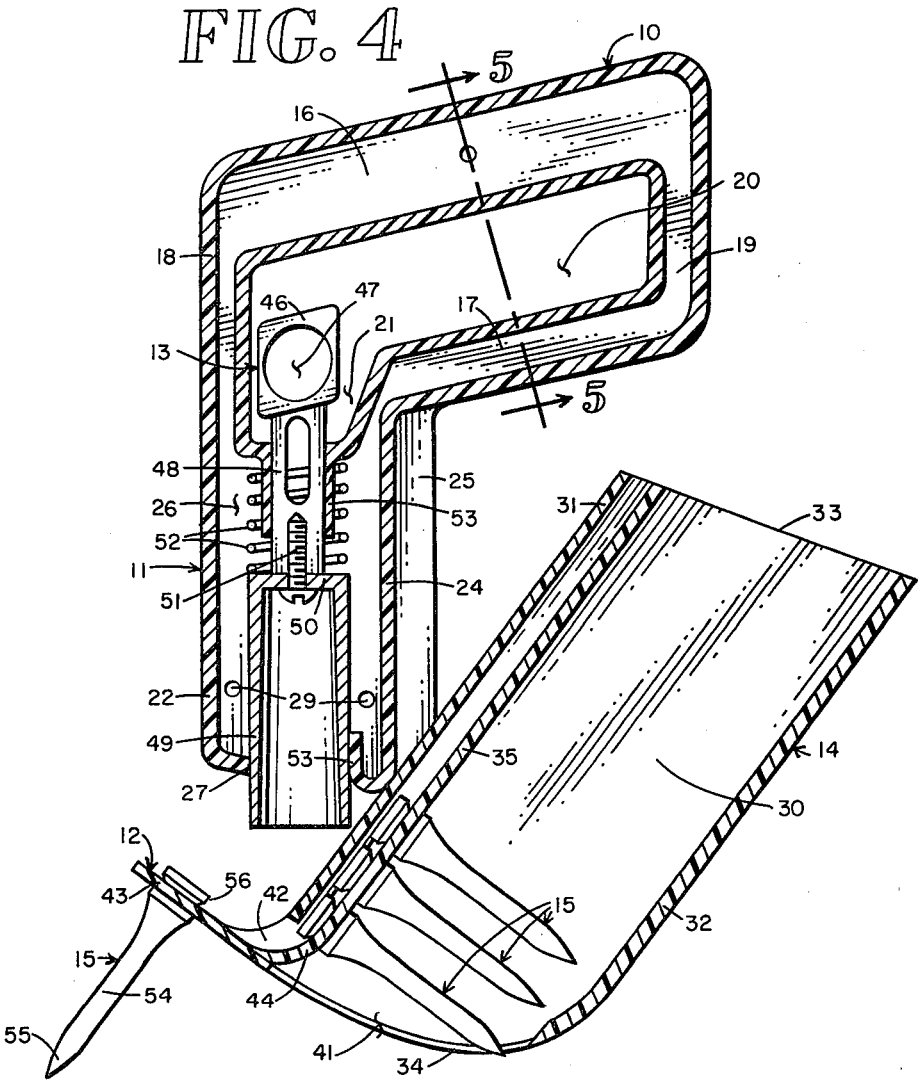
FIG. 6
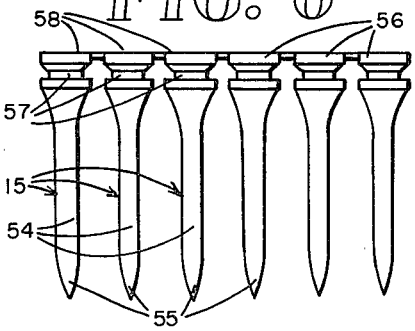
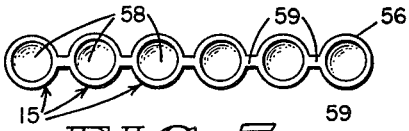
FIG. 7

PLACEMENT DEVICE FOR GOLF TEE AND BALL

BACKGROUND OF INVENTION

A. Related Applications

There are no applications related hereto heretofore filed in this or any foreign country.

B. Field of Invention

My invention relates generally to apparatus for the game of golf and more particularly to a tool for establishment of a golf tee in the earth with a golf ball supported thereon.

C. Description of Prior Art

Traditionally in the game of golf, balls are set upon a rigid tee which supports them a short distance above the earth for initial driving. Commonly a golf tee is placed, within certain limits, in the positioned desired by a particular golfer for each drive. The placement of golf tees has heretofore normally been accomplished by unaided manual manipulation, though mechanical tools of various sorts have become known to aid the operation. My invention provides a new and novel tool for this purpose.

Such tools may, for convenience of consideration, be divided into two readily discernable classes, the first comprising devices that insert only a golf tee and the second, comprising devices that insert a golf tee and establish a golf ball supportably thereon. The first class of devices are not of such utility as the second because with them a golf ball must be placed manually after tee placement and that requires very nearly as much effort as the placement of the tee in the first instance. This first class of device therefore, though known, has not found much commercial popularity.

The second class of device places a tee with ball supported thereon, normally in a single operation and usually has provided magazine type storage for either tees, balls or both. My invention constitutes a new and novel member of this class. It is distinguished from the known members of the class in providing a lineally interconnected group or cartridge of tees which is carried in a magazine type storage chamber with an end tee being manually manipuable to be fractured from the remaining group at the time of placement for use. This type of interconnected tee cartridge aids the handling of tees and simplifies their use. While my device is designed particularly to operate with interconnected groups of tees it also will operate, though not so conveniently, with individual tees of the traditional singulated type heretofore known. My invention is further distinguished from the prior art devices by allowing the user to place a predetermined ball, and particularly the ball with which he has theretofore been playing, in operative position on a tee in my device where it is maintained until it is placed whereas many known devices having a magazine type supply of golf balls have allowed placement only of a randomly determined and unselected ball.

My invention further provides for the manual association of ball with golf tee in supportable operative position by the user with subsequent maintenance of this position by mechanical means until after ground placement, both to aid the sureness of placement and the proper positioning of ball relative to tee after placement. Many prior art devices have not provided this sureness but oftentimes have relied upon probabilitistic mechanical functions for placement of ball on tee to give lower degree of reliability than my device. My invention also provides for insertion of a tee in the earth by manual manipulation of an operator so that placement force may be appropriately adjusted to particular conditions and will allow insertion to a particularly desired depth whereas prior art devices oftentimes have provided some type of mechanically activated or aided insertion which did not allow either proper insertive forces or regulation of insertion depth.

My invention lies in the combination of all of these various elements in the particular structure disclosed and not in any one of them per se. It is thusly distinguished both structurally and functionally from the various elements of the prior art either individually or in combination.

SUMMARY OF INVENTION

My invention provides an upper handle communicating with a somewhat elongate depending body which pivotably carries a laterally adjacent magazine having a holding mandrel in its lowermost portion and at a spaced distance below the body to define a ball space between body and holding mandrel. The holding mandrel defines an elongate slot communicating from the magazine and through the mandrel to frictionally engage the upper groove of an ordinarily configured golf tee and positionally maintain it. A trigger mechanism communicates from the handle portion of the device through the body to a movable holding plunger extending into the ball space. This holding plunger is spring biased to a downward position toward the mandrel to hold a golf ball in operative position on the top of a tee in the mandrel but this bias may be released by operation of the trigger in the upper handle portion of the device to allow separation of the tool and a placed tee. The magazine provides a vertical tee holding slot which engages the upper grooves of a plurality of tees and feeds the tees by gravity to the lowermost portion where the lowermost tee may be manually grasped through an opening and moved into the holding mandrel where it may be frictionally maintained. The magazine also provides storage for additional groups of interconnected tees that are not operatively positioned.

My placement device will function with traditionally singulated tees of present day commerce but not so well as with groups of tees that are fastened in lineal array by frangible fastening bridges communicating between the upper portions of adjacent tees.

In creating such a device it is:

A principal object of my invention to provide a tool that will aid the placing of a tee in the earth with a golf ball in supported position thereon.

A further object of my invention to provide such a device that operates effectively with groups of tees interconnected in linear array by frangible bridges but also will operate with individual singulated tees of present commerce.

A further object of my invention to provide such a device that allows the operator to manually position a pre-selected golf ball in supportative position on a tee and positionally maintain the combination during establishment of the tee in the earth.

A still further object of my invention to provide such a device that makes the simultaneous placing of golf ball and tee easier, less burdensome and less exertive than manual placement without use of my device.

A still further object of my invention to allow placement of a tee with golf ball in supported position thereon in any chosen area and to desired depth by appropriate manipulation.

A still further object of my invention to provide such a device that is of new and novel design, of rugged and durable nature, of simple and economic manufacture and one otherwise well suited for the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout:

FIG. 4 is a medial, cross-sectional view of the tool of FIG. 1 but with the golf ball removed and the magazine partially opened to show particularly the internal structure, operative mechanism and operation of my tool.

FIG. 6 is a vertical, orthographic view of a lineal array of interconnected tees preferred for use with my invention.

FIG. 7 is a top orthographic or plan view of the array of tees of FIG. 6.

DESCRIPTION OF THE PREFERRED EMBODIMENT

Figure 2:
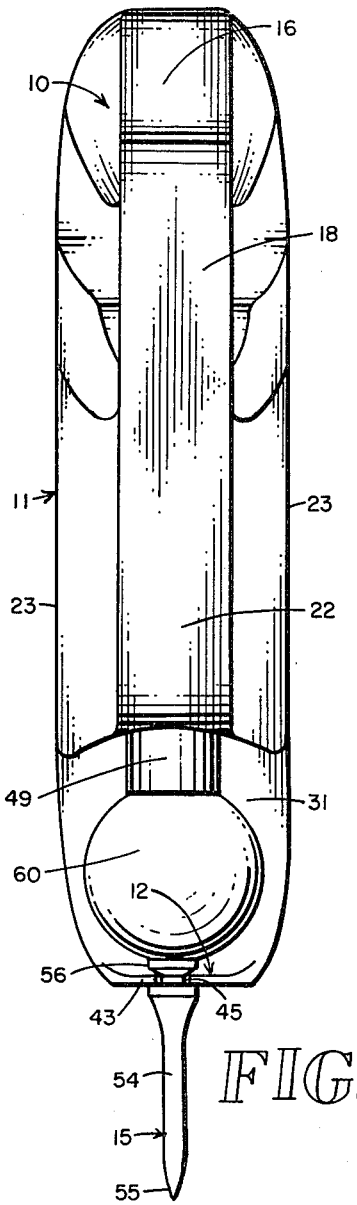
FIG. 2 is an orthographic front view taken from the left of the tool illustrated in FIG. 1 to show the same structure from this aspect.

My invention comprises, generally, upper handle 10 structurally communicating with depending body 11 which pivotably mounts adjacent magazine 14 carrying holding mandrel 12 in its lowermost portion extending to a spaced distance below the body to form a ball space therebetween, with trigger mechanism 13 carried by the body to extend into the ball space, and tees 15 carried within the magazine.

Handle 10 is formed by upper chord 16 and lower chord 17 interconnected by front 18 and back 19, all to peripherally define finger hole 20 of appropriate size to allow a conformable fit for an ordinarily sized hand. The forward portion of lower chord 17 defines trigger indentation 21 to allow appropriate motion of the trigger mechanism and allow its positioning for the most conformable hand fit. Preferably the inner surface of the handle elements defining the periphery of finger hole 20 are curvilinear with convexity in an inward direction to aid a comfortable and conformable hand fit, especially about upper chord 16. The handle is a somewhat elongate structure as illustrated and joins body 11 at an included angle somewhat greater than ninety degrees to provide for easier manual manipulation of the device.

Body 11 is a peripherally defined prismoidal element formed by front 22, similar sides 23 and back 24 all structurally intercommunicating to form a rigid column structurally depending from the lower forward portion of handle 10. Preferably back element 24 of the body has paired opposed rearwardly extending elongate flanges 25 at each side to fit about and frictionally engage the forward portion of the magazine element. Similar cooperating, opposed magazine axle holes are defined in the lower portion of flanges 25 to support the magazine axles which pivotably mount magazine 14. The absolute vertical dimension of the body is not particularly critical so long as it be related to the dimension of the magazine to allow an appropriate ball space between body and holding mandrel. Again, preferably the vertical extension of both body and magazine is substantially within the peripheral limits of the handle element as illustrated Internal chamber 26 defined by the peripheral elements of the body must be such size to allow for containment of trigger mechanism 13. An appropriately configured trigger hole 27 is defined in the upper portion of the body to allow passage of the trigger stem and ball plunger hole 27 is defined in the lower portion to allow passage and vertical motion of the ball plunger.

Normally handle structure 10 and body structure 11 will be formed as peripherally defined rigid elements in a unitary fashion as illustrated. I prefer to form these elements as two similar halves from moldable plastic and thereafter join them by mechanical fastening, such as screws 29, fastenably extending therebetween.

Magazine 14 comprises a rigid, peripherally defined parallelogram-like, open top box formed with similar sides 30, front 31, back 32 and bottom 33. The angle of the parallelogram of sides 30 should be such as to allow a nice fit against the bottom portion of lower chord 17 of the handle when front 31 of the box is rearwardly adjacent back 24 of the body, as illustrated particularly in FIG. 1. Internally magazine 14 has forward transverse septum 35 defining tee slot 36 in its medial part at a spaced distance rearwardly of the rearward or inner surface of front 30. The dimensioning of these elements is such that the upper groove of tee 15 slidably fits within tee slot 36 with the head portion of the tee slidably carried between the adjacent surfaces of transverse septum 35 and magazine front 31 and the body of the tee carried between the adjacent surfaces of the transverse septum 35 and magazine back 32. Magazine chamber 37 is divided from laterally adjacent storage chambers 38 by similar septums 39 on each side thereof, structurally extending between adjacent surfaces of transverse septum 35 and back 32.

The middle forward portion of each side 30 of the magazine carries similar opposed, cooperating magazine axles 40 extending laterally therefrom in position to pivotably engage magazine axle holes 28 in the body element. These axles 40 are positioned, as illustrated particularly in FIG. 1, to pivotably mount the magazine on body 11 with its upper portion immediately adjacent the lower surface of lower chord 17 of the handle element and its front 31 immediately adjacent back 34 of the body. It is to be noted that when the magazine be mounted in this position its shape will allow pivotable motion relative to the body and the holes.

The vertical dimension of the magazine must be related to that of body 11 so that it extends vertically below the lowermost extension of body 11 a distance slightly greater than the diameter of a golf ball, again as illustrated particularly in FIGS. 1 and 2. Magazine bottom 33 vertically below magazine chamber 37 is removed to define tee slot 41 to allow tees to exit from the lowermost portion of magazine chamber. Similarly the lowermost portion of front 31 forwardly of magazine chamber 37 is cut away slightly above bottom 33 to define tee head slot 42 to allow the exit of tee heads forwardly of frame 31 of the magazine.

Holding mandrel 12 comprises forward extension 43 of transverse septum 35 of the magazine. The communication of the vertical magazine septum 35 with horizontal forward extension 43 is accomplished by curvilinear transition element 44. The curve of this transition element is relatively sharp so as to allow passage of a golf tee head but yet tend to aid in fracturing the frangible web interconnecting the tee with its adjacent tee. Normally this bend is substantially as illustrated in FIG. 4 with a radius of approximately three quarters of an inch for tees of the normal size of present day commerce. Tee slot 45 is defined in forward extension 43 of the holding mandrel to constitute an extension of slot 36 in transverse septum 35 of the magazine. Slot 45, however, is slightly narrower so as to provide frictional fit about the upper groove of a tee to allow frictional maintenance of the tee at a particular position.

Magazine 14 and holding mandrel 12 must both be formed from some reasonably rigid, durable material and again, I prefer a hard molded plastic for this purpose. The shape of both of these elements is well suited to formation by normal molding processes. Plastic material also provides appropriate rigidity for its purposes but yet allows sufficient elastic deformation to avoid excessive wear and allow passage of tees through slot 45 notwithstanding their frictional engagement therein.

Trigger mechanism 13 is seen especially in FIG. 4. The assemblage provides upper trigger 46 defining finger hole 47 therein and structurally communicating by depending trigger shaft 48 with elongate, peripherally defined ball holding cylinder 49 having top 50 but no bottom. The ball holding cylinder and trigger shaft are normally separately formed, and if so, mechanically interconnected such as by fastenably intercommunicating screw 51. Trigger shaft 48 is of somewhat smaller peripheral dimension than ball holding cylinder 49 so that compression spring 52 may be placed about the trigger shaft but yet may not move downwardly past top 50 of the ball holding cylinder. The upper portion of the compression spring fits against the lower surface of the upper portion of body 11 so as to bias the trigger, trigger shaft and ball holding cylinder to a lowermost position but yet allow their motion, upon manual manipulation, upwardly against this bias.

Figure 1:
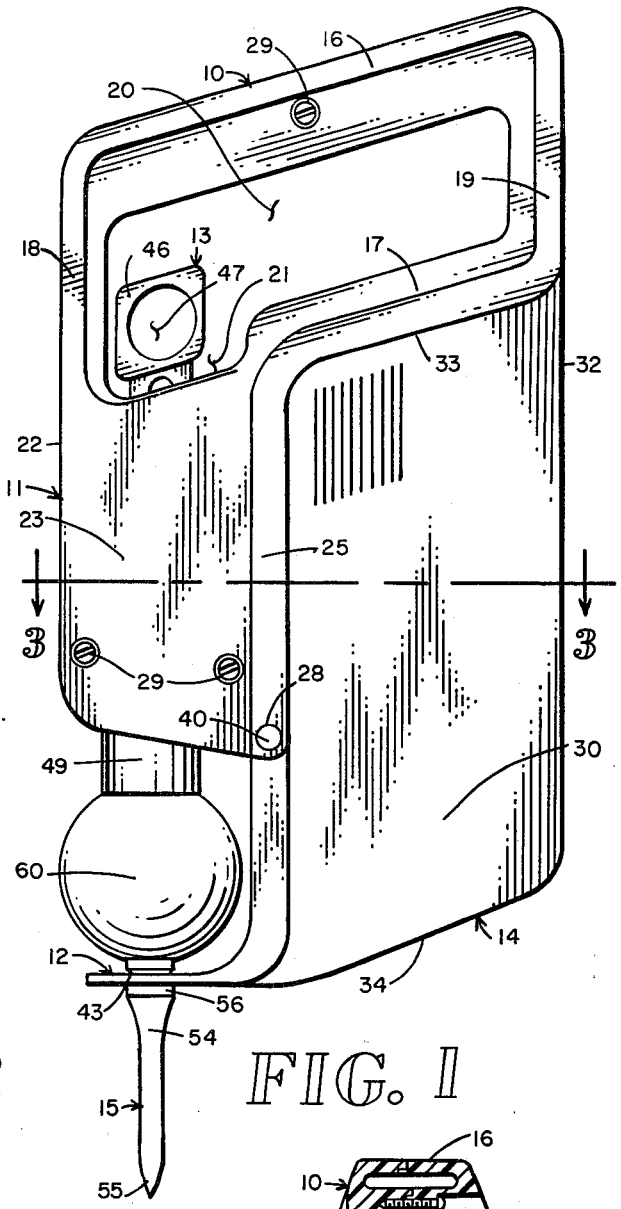
FIG. 1 is an orthographic side view of my tool showing its various parts, their configuration and relationship.
Figure 3:
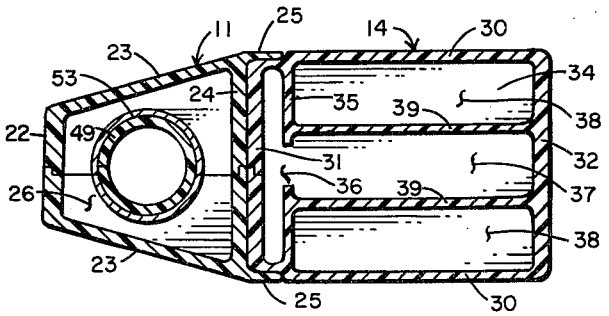
FIG. 3 is a horizontal, cross-sectional view through the body and magazine of the tool illustrated in FIG. 1, taken on the line 3—3 thereon in the direction indicated by the arrows.
Figure 5:
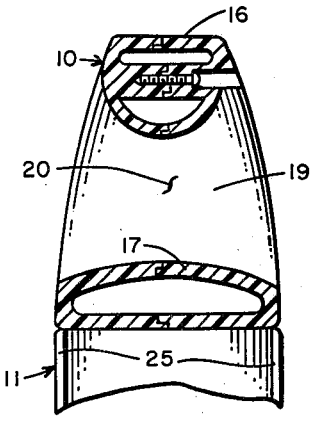
FIG. 5 is a cross-sectional view through the handle of the tool of FIG. 4, taken on the line 5—5 in the direction indicated by the arrows thereon.

The vertical dimensioning of the trigger mechanism is critical in relation to the dimensioning of the body and magazine as seen in FIG. 1 and FIG. 4. The lowermost portion of ball holding cylinder 49 when in biased condition must extend some distance below the lowermost surface of body 11 but yet must be movably vertically upwardly against its bias, by normal finger pressure of an operator, to a position near the lowermost portion of the body so that it may hold and release a ball as hereinafter more particularly described. The trigger mechanism is substantially vertically above the slot 45 defined in the holding mandrel and, preferably, is maintained in vertical alignment during its motion by properly configured trigger guides 53 structurally carried in appropriate position by the inner surface of body 11 to extend inwardly therefrom to guide the motion of the trigger mechanism. The internal diameter of the chamber defined by ball holding cylinder 49 is less than the diameter of a golf ball but sufficient to reasonably well symmetrically align a golf ball, normally approximately one inch.

Tees 15 for use with my invention preferably are of the reasonably standardized configuration of present day commerce and substantially as illustrated in FIGS. 6 and 7. The tees have smaller cylindrical body portion 54, formed to point 55 in its lowermost part, communicating in its upper part with diametrically larger head 56 having annular groove 57 defined in its medial portion. Uppermost surface 58 of the head of the tee is configured as a spherical sector to conformably receive the surface of a golf ball and support it vertically thereabove. The configuration and size of tees used in modern day golf have become reasonably standardized and I prefer to follow these standards in design and dimensioning of my tees and tool.

Preferably for use with my invention a plurality of such tees are joined in lineal array by small webs 59 extending between the uppermost portion of the heads of adjacent tees. These webs must be formed of frangible material and with such size that it is easily fractured by manual manipulation. These interconnecting tees again, may be readily formed by molding processes from plastic or other materials. Ideally the tees are formed from biodegradable materials such as mixtures of vegetative matter, soil, fertilizer and the like with an appropriate binder so that any unrecovered tees tend to disintegrate into the soil and aid its fertility.

Having thusly described the structure of my invention its use may be understood.

Firstly, a placement tool is formed according to the foregoing specifications and groups of interconnected tees are formed of appropriate size to fit within the magazine chamber.

For use the magazine is opened as illustrated in FIG. 4 and the magazine chamber filled with tees by establishing a lineal array of tees with their upper grooves 57 slidably engaged in tee slot 36 of transverse septum 35 of the magazine. The magazine is then pivoted to a closed position as illustrated in FIG. 1 where it is positionally maintained by frictional engagement between magazine flanges 25. When the tool then be held in substantially vertical position tees carried in magazine chamber 37 will move to a downwardmost position with the head of the lowermost tee immediately above the bend of curvilinear transition element 44. With a tee in this position its point will project through tee slot 41 defined in the bottom of the magazine so that the tee may be manually grasped. To move a tee into operative position, the lower port of the body, near point 55, is grasped and the tee manually moved downwardly and forwardly along curvilinear transition 44 and into tee slot 45 of the holding mandrel. As this motion is accomplished connecting web 59 connecting the lowermost tee to that immediately upwardly adjacent will normally be fractured by the motion and if not may be fractured by appropriate manual manipulation.

The particular tee then is moved into a position in tee slot 45 vertically below ball holding cylinder 49 of the trigger mechanism as illustrated in FIG. 1. During this operation the placement device will normally be held by the handle by the hand of principal dexterity of a user by grasping upper chord 16 of the handle and extending his fingers through finger hole 20 and about the upper chord.

With the tee in appropriate position in the holding mandrel, below the holding cylinder, a finger, normally the index finger, is inserted in finger hole 47 of trigger 46 and the trigger moved upwardly with appropriate motion of the trigger engaging finger to raise ball holding cylinder 49 against its bias. Golf ball 60 is then positioned, by the other hand not holding the tool, immediately above and in engagement with the head of the tee. Both the ball and tee are manually maintained in this position while the trigger is released by appropriate finger motion so that its spring bias will move the ball holding cylinder into contact with the upper surface of ball 60. Since holding mandrel 12 is rigid, both golf ball and tee will be maintained in this position by the bias of the holding cylinder exerting a force between it and the holding mandrel.

With the ball and tee so positioned the placement tool is manually positioned with the point of the tee in the holding mandrel immediately above the position where it is desired that it be inserted in the earth. The placement tool is then forced vertically downwardly to insert the tee in the earth to the particular depth desired. Immediately thereupon trigger 46 is raised against its downward bias by appropriate finger motion to raise ball holding cylinder 49 out of contact with ball 60 and thusly release it. The placement device is then moved laterally by appropriate manual manipulation so that holding mandrel 12 moves away from and finally is completely disengaged from the supported tee which then will be in proper playing position with golf ball 60 in supported position thereon. Obviously in accomplishing the motion to remove the tool from a supported tee, since the golf ball is not mechanically connected to the tee neither ball nor tee may be physically disturbed sufficiently to shake the ball from the tee. It is quite simple, however, to learn to remove the tool from a supported tee after release of the ball without disturbing the relative positioning. Again, obviously when the tee is positioned in the holding mandrel slot it must be substantially vertically below the holding cylinder to maintain the ball on its upper surface. This positioning is readily accomplished with a little practice and presents no greater problem than when tee and ball be completely manually placed.

It is to be particularly noted from the foregoing description that the absolute length of both body and magazine may be quite as long as desired so long as the two be appropriately related to each other. These lengths may be sufficient to allow the device to be used without the user's having to bend over. Normally, however, it has been found that a placement tool with an overall vertical dimension of approximately twelve inches does not require any excessive exertion for use and generally is easier to use than one of greater vertical dimension, as in the bending operation by far the greatest amount of exertion occurs when the hands must be positioned within the first foot above the surface supporting the feet.

It is further to be noted that my tool is operative with one or a plurality of tees in the magazine chamber and that these tees may be connected as described hereinbefore or may be disconnected. My tool will operate quite as well with one as the other but interconnected tees are generally more simple and easier to handle.

The foregoing description of my invention is necessarily of a detailed nature so that a specific embodiment of it might be set forth as is required but it is to be understood that various modifications of detail, rearrangement and multiplication of parts may be resorted to without departing from its spirit, essence or scope.

Having thusly described my invention, what I desire to protect by Letters Patent and what I claim is:

1. A tool for positioning a golf tee, with a golf ball supported thereon, in the earth comprising, in combination:

a rigid handle communicating in its lower forward part with an elongate depending rigid body;

a peripherally defined magazine, carried by the body, having a transverse septum defining a vertical tee slot to receive and slidably maintain a golf tee and means to allow exit of a golf tee from the bottom thereof;

a holding mandrel, carried by the magazine, communicating with the lowermost portion of the transverse septum and extending under the body at a spaced distance therebelow, said holding mandrel having a tee slot defined therethrough to communicate with the tee slot defined in the transverse septum and to frictionally engage a tee therein but allow its passage therealong; and trigger mechanism carried by the body including a vertically moveable ball holding cylinder extending below the lowermost extension of the body, means of biasing the ball holding cylinder to a lowermost position and means of moving the ball holding cylinder upwardly against such bias.

2. The invention of claim 1 further characterized by:

the rigid handle being elongate, extending away from the body at an included angle greater than ninety degrees, and peripherally defining an elongate finger hole; and the magazine being mounted for pivotable motion on the lower rearward part of the body with its forward surface adjacent the body and its upper surface adjacent the lower portion of the handle that extends away from the body.

3. A tool for placement of a golf tee in the earth with a golf ball in supported position thereon comprising, in combination:

an elongate, rigid handle, defining the periphery of a finger hole, structurally communicating at an included angle somewhat greater than a right angle with a rigid, elongate, depending body having a planar rear surface with similar opposed paired magazine flanges extending from the side edges thereof;

a rigid, open tope magazine pivotably mounted on the lower portion of the body for pivotal motion relative the body with its part adjacent the body frictionally engagable between the magazine flanges of the body, said magazine having a transverse septum defining a tee channel to slideably receive a golf tee, and a tee slot in the lower portion of the magazine to allow passage of a tee carried in a tee channel from the magazine;

a holding mandrel carried by the lower part of the magazine and extending substantially perpendicularly from the magazine and under the body at a spaced distance therebelow, said holding mandrel communicating by a curved transition element with the lowermost portion of the transverse septum and having a tee slot, communicating with the tee slot defined by the transverse septum, to frictionally engage a tee but allow its passage therethrough; and trigger mechanism, carried for vertical motion in the body, having an uppermost trigger, with a trigger stem depending therefrom to communicate with a ball holding cylinder extending below the lowermost portion of the body and closer to the holding mandrel than the diameter of a golf ball to be supported thereby, said trigger mechanism being mechanically biased to a lowermost position but movable against such bias by manual manipulation of the trigger.

4. The invention of claim 3 further characterized by the magazine having chambers on each side of the magazine chamber to store a plurality of tees.

* * * * *